US007389821B2

(12) United States Patent
Xu

(10) Patent No.: US 7,389,821 B2
(45) Date of Patent: Jun. 24, 2008

(54) DOWNHOLE TRIGGER DEVICE HAVING EXTRUDABLE TIME DELAY MATERIAL

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 65 days.

(21) Appl. No.: 11/598,966

(22) Filed: Nov. 14, 2006

(65) Prior Publication Data

US 2008/0110615 A1 May 15, 2008

(51) Int. Cl.
*E21B 23/08* (2006.01)

(52) U.S. Cl. ..... 166/381; 166/319; 166/383

(58) Field of Classification Search ..... 166/381, 166/383, 120, 319
See application file for complete search history.

(56) References Cited

U.S. PATENT DOCUMENTS

| | | | |
|---|---|---|---|
| 4,178,992 | A | 12/1979 | Regan et al. |
| 4,379,722 | A | 4/1983 | Scott |
| 4,621,987 | A | 11/1986 | Spingath, Jr. |
| 4,705,118 | A | 11/1987 | Ennis |
| 4,771,831 | A | 9/1988 | Pringle et al. |
| 5,046,557 | A | 9/1991 | Manderscheid |
| 5,398,998 | A | 3/1995 | Evans |
| 5,441,111 | A | 8/1995 | Whiteford |
| 5,752,814 | A | 5/1998 | Starks et al. |
| 6,142,227 | A | 11/2000 | Hiorth et al. |
| 6,923,263 | B2 | 8/2005 | Eden et al. |
| 2002/0088616 | A1 | 7/2002 | Swor er al. |
| 2004/0040710 | A1 | 3/2004 | Eden et al. |
| 2005/0241855 | A1 | 11/2005 | Wylie et al. |
| 2006/0005968 | A1 | 1/2006 | Vinegar et al. |

*Primary Examiner*—David J. Bagnell
*Assistant Examiner*—Brad Harcourt
(74) *Attorney, Agent, or Firm*—Greenberg Traurig LLP; Anthony F. Matheny

(57) ABSTRACT

A trigger device for setting a downhole tool includes a retaining member that restricts the downhole tool from setting until it is properly positioned within the well and a force acts upon an actuating member. The retaining member includes an extrudable material that extrudes through an orifice when the force acts upon the actuating member. The extrudable material is preferably one that moves at a known rate so that the amount of time necessary for the downhole tool to set is pre-determined.

20 Claims, 2 Drawing Sheets

DOWNHOLE TRIGGER DEVICE HAVING EXTRUDABLE TIME DELAY MATERIAL

BACKGROUND

1. Field of Invention

The present invention is directed to trigger devices for actuating downhole tools and, in particular, trigger devices having an extrudable material such that when the extrudable material is moved, e.g., compressed or extruded, by an actuating member in the trigger device so that the actuating member moves at a steady, known rate to actuate the downhole tool.

2. Description of Art

Some downhole tools need to be retained in an unset position until properly placed in the well. It is only when they are properly located within the well that the downhole tool is set. Such downhole tools in the past have had trigger mechanisms that are retained in an immovable position while the downhole tool is being "run" into the well and properly placed within the well. One prior technique for holding the trigger mechanism immobile until the downhole tool is properly placed in the well involves disabling the trigger with a mechanical device that is held against movement by a Kevlar® high strength fiber and an associated electrically powered heat source generally powered by stored batteries in the downhole tool. The generation of sufficient heat burns the fibers and releases the trigger so that the tool can set. Such a system is described in U.S. Pat. No. 5,558,153. One problem with this trigger mechanism is that it is extremely difficult to generate sufficient heat downhole to burn the fibers without damaging adjacent components. This is because the physical size of the battery pack must be large enough to provide sufficient energy to generate the necessary temperature, for the necessary duration, to break the fibers. Another issue is the very high temperatures needed to break the fibers and the effect on the overall design of the downhole tool from having to keep heat sensitive components away from the heated area.

Another prior trigger mechanism includes a battery operated heater coil in a downhole tool to release the trigger by applying heat and melting a plug to start the setting sequence. This design is reflected in U.S. Pat. No. 6,382,234. As with the other prior attempt, the size of the battery to provide the required electrical capacity to create enough heat to melt the plug presents a space concern in a downhole tool where space for a large power supply is at a premium. Further, the heat sensitive components must be shielded from the heater coil. The cost and the reliability of a large battery pack is also can be a problem. Additionally, safety is another issue because some batteries need special shipping and handling requirements.

Still other alternatives involve the large battery pack to accomplish a release of the trigger. For example, U.S. Pat. No. 5,558,153 also suggests using solder wire that melts at relatively low temperatures to be the trigger material or using the stored power in the battery to advance a knife to physically cut the fiber as opposed to breaking it with a battery operated heat source.

Accordingly, prior to the present inventions trigger devices and methods for actuating downhole tools have been desired in the art which: permit customization of the trigger device such that the amount of time for the trigger device to be activated is predetermined; permit steady movement of the actuating device at a known rate; and permit setting of downhole tools without the need for heat from an external heating source other than wellbore temperature.

SUMMARY OF INVENTION

Broadly, the trigger devices for downhole tools have a housing or body, an actuating member, and a retaining member. The retaining member includes an extrudable material. The retaining member prevents movement of the actuating member until the extrudable material of the retaining member is moved, e.g, extruded or forced out of the path of movement of the actuating member. As the extrudable material is moved the actuating member moves and, thus, sets the downhole tool. In certain specific embodiments, the movement of the extrudable material sets the downhole tool by one or more of freeing a piston to move or by any other mechanism known to persons skilled in the art.

The extrudable material may be any material known to persons of ordinary skill in the art. Preferably, the extrudable material operates as a time delay device that can be calibrated with the passage of time. Thus, the extrudable material permits movement of the actuating member within a known period of time such that the downhole tool, regardless of type of downhole tool, can be placed in a desired location in the wellbore and the downhole tool actuated within a known period of time. Accordingly, the extrudable material has a known rate of movement such that an operator of the downhole tool is able to predetermine the amount of time for the extrudable material to sufficiently move so that the actuating member can move and, thus, set the downhole tool.

Further, because the extrudable materials can be easily calibrated, they can be customized for various depth wells, and various wellbore temperatures. The extrudable materials can also be customized to sufficiently move and allow setting of various downhole tools.

Additionally, the inclusion of the extrudable material to assist maintenance of the downhole tool in its "unset" or "run-in" position permits the easy formation of various sized trigger devices depending on the size of the housing or chamber of the downhole tool in which the trigger device is placed. As necessary, additional or less extrudable material may be used to form the retaining member to properly fit within the housing of the downhole tool.

Further, movement of the extrudable material does not require generation of heat from a heat source other than the wellbore temperature. As a result, no heating element or batteries are required. Therefore, a simpler, more efficiently sized, and less expensive designed downhole tool is achieved.

In one aspect, one or more of the foregoing advantages have been achieved through a trigger device for a downhole well tool, the trigger device capable of selectively actuating the downhole tool. The trigger device comprises a housing; an actuating member operatively carried by the housing, wherein the movement of the actuating member from a first position to a second position causes a downhole tool to perform a specified function; and a restraining member operatively associated with the actuating member to initially prevent movement of the actuating member from the first position to the second position, the restraining member comprising a solid extrudable material adjacent an opening, wherein a selected force acting on the actuating member causes the actuating member to push at least a portion of the extrudable material through the opening, allowing the actuating member to move from the first position to the second position.

A further feature of the trigger device is that the actuating member may comprise a piston. Another feature of the trigger device is that the extrudable material may be mounted in contact with the piston. An additional feature of the trigger device is that the opening may be located in a shoulder in the housing and the extrudable material is located between the piston and the shoulder. Still another feature of the trigger device is that the housing may include a rupture disk in fluid communication with one side of the piston for creating a passage for wellbore fluid to the one side of the piston when a selected wellbore pressure is reached. A further feature of the trigger device is that the piston may be located in a chamber that is selectively exposed to hydrostatic pressure in the well to create the selected force on the piston. Another feature of the trigger device is that the housing may include a cavity for receiving the extrudable material after being pushed through the opening. An additional feature of the trigger device is that the extrudable material may comprise a sleeve mounted around a portion of the actuating member. Still another feature of the trigger device is that the extrudable material may comprise a polymer.

In another aspect, one or more of the foregoing advantages may also be achieved through a trigger device comprising a housing; a piston operatively carried by the housing, wherein the movement of the piston from a first position to a second position causes a downhole tool to perform a specified function; and a restraining member operatively associated with the piston to initially prevent movement of the piston from the first position to the second position, the restraining member comprising a solid extrudable material adjacent an opening, the opening being located in a shoulder in the housing and the extrudable material being located between the piston and the shoulder, wherein a selected force acting on the piston causes the piston to push at least a portion of the extrudable material through the opening, allowing the piston to move from the first position to the second position.

A further feature of the trigger device is that the extrudable material may be a polymer. Another feature of the trigger device is that the housing may include a rupture disk in fluid communication with one side of the piston for creating a passage for wellbore fluid to the one side of the piston when a selected wellbore pressure is reached. An additional feature of the trigger device is that the piston may be located in a chamber that is selectively exposed to hydrostatic pressure in the well to create the selected force on the piston. Still another feature of the trigger device is that the housing may include a cavity for receiving the extrudable material after being pushed through the opening. A further feature of the trigger device is that the extrudable material may comprise a sleeve mounted around a portion of the actuating member.

In an additional aspect, one or more of the foregoing advantages may be achieved through a method of selectively actuating a downhole tool. The method comprises the steps of: (a) retaining an actuating member of a downhole tool against movement with a restraining member, wherein the restraining member comprises at least one solid extrudable material located adjacent an opening; (b) lowering the tool into a wellbore; (c) applying a force to the actuating member; and then (d) pushing the extrudable material with the actuating member through the opening and actuating the downhole tool in response to the movement of the actuating member.

A further feature of the method of selectively actuating a downhole tool is that step (c) may be performed by placing the actuating member into fluid communication with a wellbore environment. Another feature of the method of selectively actuating a downhole tool is that step (c) may be performed by applying hydrostatic pressure of the wellbore to a piston of the actuating member. An additional feature of the method of selectively actuating a downhole tool is that step (c) may be performed by isolating the piston of the actuating member from wellbore fluid in the wellbore until reaching a desired setting depth, then placing the piston of the actuating member in fluid communication with the wellbore fluid. Still another feature of the method of selectively actuating a downhole tool is that the piston of the actuating member may be placed in fluid communication with hydrostatic pressure of the wellbore by rupturing a rupture disk.

The trigger devices and methods disclosed herein have one or more of the following advantages: permitting customization of the trigger device such that the amount of time for the trigger device to be activated is pre-determined; permitting steady movement of the actuating device at a known rate; and permitting setting of downhole tools without the need for heat from an external heating source other than wellbore temperature.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
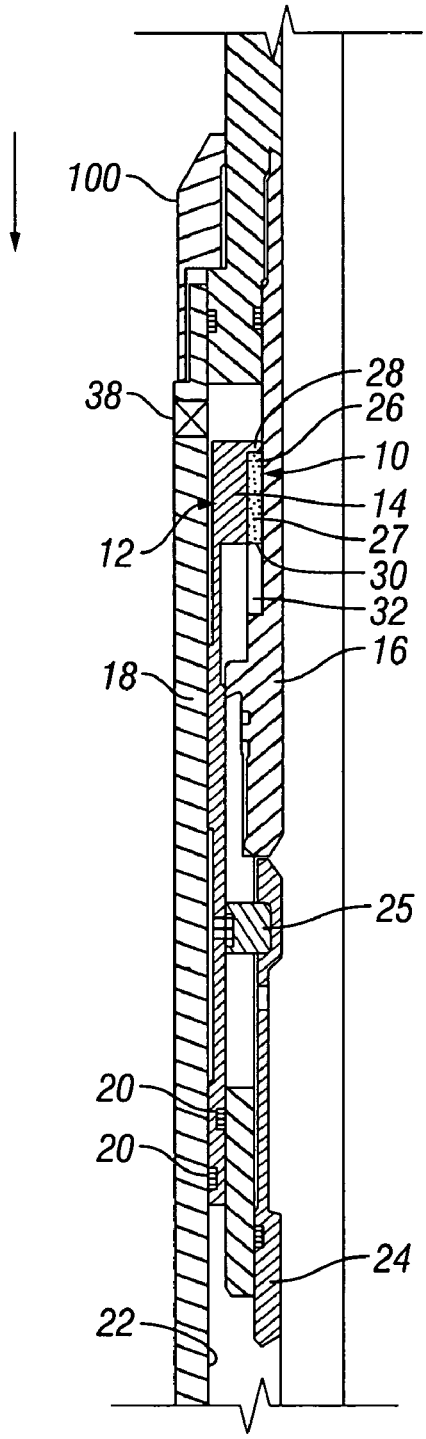
FIG. 1 is a cross-sectional view of one specific embodiment of the trigger device of the present invention shown in its initial or run-in position.
Figure 2:
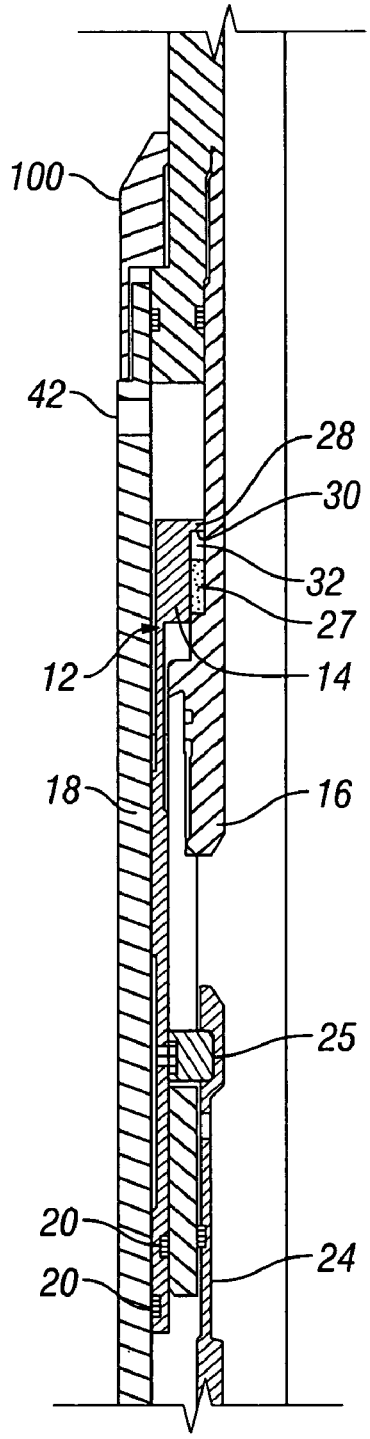
FIG. 2 is a cross-sectional view of the trigger device shown in FIG. 1 in its actuated position.
Figure 3:
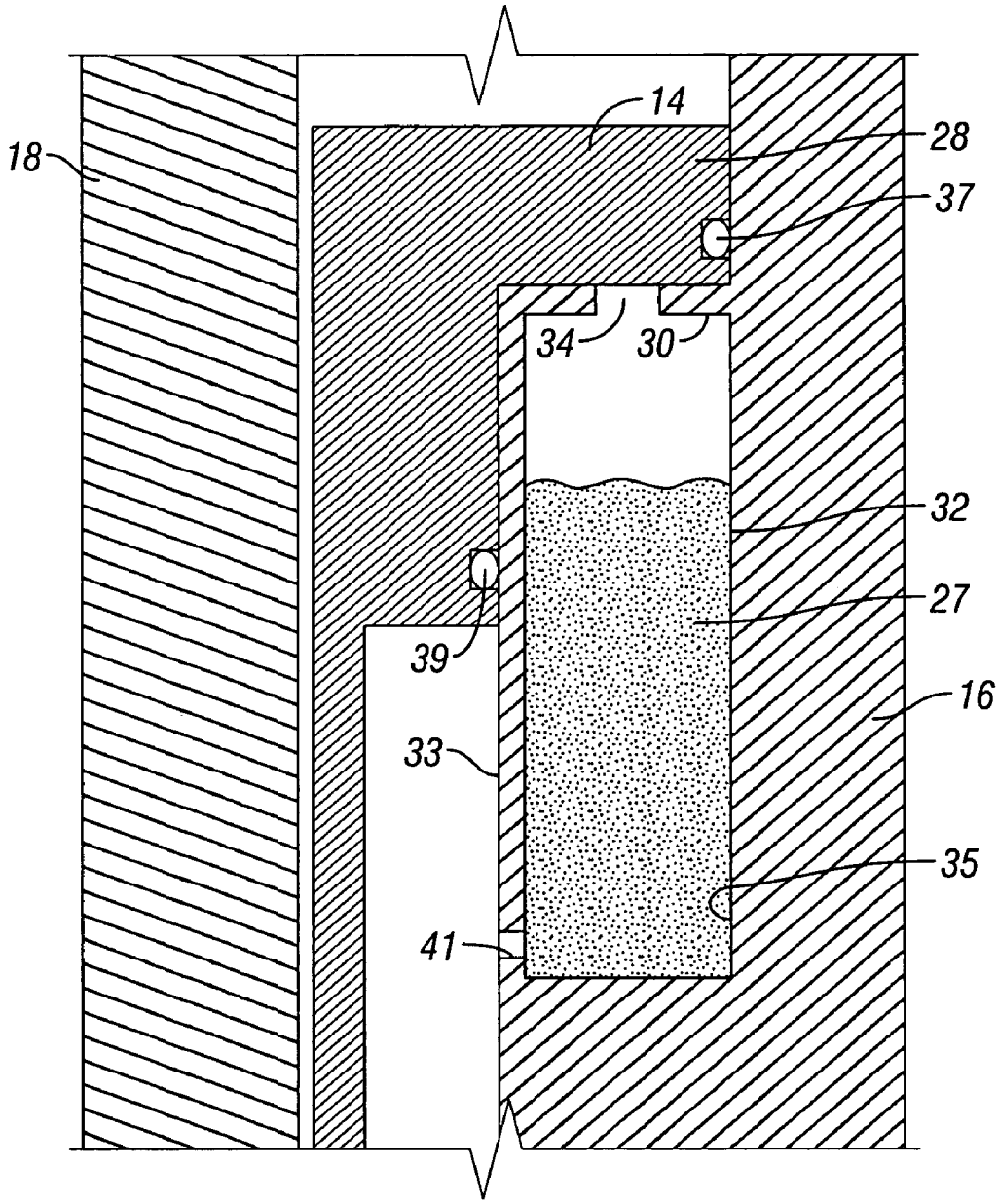
FIG. 3 is an enlarged cross-sectional view of the piston shown in FIG. 2 in its actuated position.

Referring to FIGS. 1-3, in one embodiment, trigger device 10 is included as part of downhole tool 100. Downhole tool 100 is lowered on a string of conduit into the well and may be used for setting a packer, a bridge plug, or various other functions. Trigger device 10 has actuating member 12, which as shown in FIGS. 1-3, is piston 14. Generally, movement of actuating member 13, e.g., piston 14, sets downhole tool after it is properly located in a well (not shown). As shown in FIG. 1, piston 14 is in its initial or "run-in" position. The initial position is the position prior to actuation of downhole tool 100. FIGS. 2 and 3 show piston 14 in the actuated position.

In this embodiment, piston 14 comprises a sleeve carried in an annular chamber around a central mandrel assembly 16 of tool 100 and within a housing 18 of tool 100. Piston 14 has inner and outer seals 20 that slidably engage mandrel assembly 16 and the inner side wall 22 of housing 18 when actuated. Piston 14 is connected to tool actuator 24 by key 25 extending through an elongated slot in mandrel assembly 16 to move tool actuator 24 downward, i.e., in the direction of the arrow, when piston 14 moves downward. Tool actuator 24 performs a desired function, such as setting a packer. Thus, downhole tool 10 is actuated and functional as a result of tool actuator 24 being moved.

During actuation of piston 14 and, thus, tool actuator 24, a force is applied to piston 14 in the direction of the arrow. The force can come from a variety of sources such as hydrostatic pressure, fluid pressure pumped from the surface, or various springs or other energy storage devices or equivalents. When applied, the force would otherwise move piston 12 in the direction of the arrow except that restraining member 26 initially restricts, prevents, or otherwise limits movement of piston 14.

Retaining member 26 facilitates maintenance of actuating member 12, e.g., piston 14, in the run-in position. As shown in FIG. 1, retaining member 26 is completely formed of an extrudable material 27. However, it is to be understood that retaining member 26 may be only partially formed by an extrudable material such that the extrudable material comprises only a portion of retaining member 26. In this example, retaining member 26 comprises a sleeve within an inner diameter portion of piston 14. Retaining member 26 and piston 14 are arranged so that piston 14 cannot move relative to retaining member 26 in the direction of the arrow until the force discussed above is applied. An inward extending lip 28 of piston 14 contacts an upper end of retaining member 26 to limit downward movement of piston 14 relative to retaining member 26.

Retaining member 26 has an inner diameter that receives mandrel assembly 16. Retaining member 26 is mounted to mandrel assembly 16 in a manner to restrict movement of retaining member 26 relative to mandrel assembly 16 in the direction of the arrow. In this embodiment, a lower end of retaining member 26 engages an upward facing shoulder 30 of mandrel assembly 16 to prevent downward movement. In the specific embodiment shown in FIGS. 1-3, mandrel assembly 16 includes annular cavity 32 disposed below upward facing shoulder 30.

Annular cavity 32 is defined by outer and inner cylindrical walls 33, 35 on mandrel 16. The bottom of annular cavity 32 is closed and the top of annular cavity 32 is defined by shoulder 30. Piston 14 has a seal 37 on lip 28 that seals against mandrel 16 above shoulder 30. Seal 39 on piston 14 seals against mandrel outer wall 33. Vent 41 vents annular cavity 32 to the exterior of mandrel 16. Restricted opening 34 in shoulder 30 provides fluid communication between retaining member 26 and annular cavity 32. While in the "run-in" position (FIG. 1), annular cavity 32 is preferably empty and at atmospheric pressure. During movement of downhole tool 100 from the run-in position to the "set" position (FIGS. 2-3), the extrudable material 27 of retaining member 26 is moved, i.e., forced or extruded, through opening 34 into annular cavity 32 by the force acting downward on piston 14. In certain specific embodiments, numerous openings 34 are present. Further, the size of the one or more openings 34 can be easily customized for each specific downhole tool 100 and the desired rate of movement for actuation of downhole tool 100.

The term "extrudable material" as used herein for retaining member 26 means that the material is capable of being moved, e.g., forced or extruded through opening 34 when downhole tool 100 is moved from the unset position (FIG. 1) to the set position (FIGS. 2-3). "Extrudable material" refers to a solid material that can be forced through an opening under a force caused by wellbore pressure and temperature.

The extrudable material may be any material known to persons of ordinary skill in the art that can be moved, e.g., compressed, deformed, or extruded, over an amount of time by a force acting on actuating member 12. Preferably, the extrudable material is calibrated such that the amount of time necessary for the extrudable material to be moved sufficiently to permit actuating member 12 to move from the unset position to the set position is known or easily determinable without undue experimentation. Suitable extrudable materials include polymers and elastomers, for example, the polymer HYDROCENE™ available from Idroplax, S.r.l. located in Altopascia, Italy. Preferably, extrudable material 27 is a toroidal-shaped single member, but it could comprise a plurality of beads of material.

In calibrating the rate of extrusion of the extrudable material, generally the rate is dependent on the density and hardness or malleability of the extrudable material. In one embodiment, the extrudable material is sufficiently movable over a period of time ranging from 1 hour to 240 hours and over a temperature range from about 50° C. to 250° C. Preferably, the force exerted by actuating member 12, the amount of time that the force is applied, and the temperature within downhole tool 100, which is usually the same as the wellbore temperature and which increases the flowability of the extrudable material, all act together to move the extrudable material; however, the temperature should be less than the melting point of extrudable material. Thus, the extrudable material does not begin moving through opening 34 solely by movement of piston 14. Instead, an elevated temperature can also be present to facilitate movement of the extrudable material. Additionally, the size of opening 34 through which the extrudable material is extruded in certain embodiments can also, either alone or in combination with force, time, and/or well temperature, facilitate movement of the extrudable material.

It is to be understood that the apparatuses and methods disclosed herein are considered successful if the extrudable material 27 is sufficiently moved such that the actuating member 12, e.g., piston 14, is moved from its initial or "run-in" position (FIG. 1) to its actuated or "setting" position (FIGS. 2-3) so that the downhole tool is set. In other words, the apparatuses and methods are effective even if all of the extrudable material 27 is not moved out by the actuating member 12. In one specific embodiment, at least 50% of the extrudable material 27 is moved. In other specific embodiment, at least 90% of the extrudable material 27 is moved.

Still with reference to FIG. 1, trigger device 10 also includes rupture disk 38 that is designed to break-away at predetermined depths due to hydrostatic pressure of the well fluid or fluid pressures applied by pumps at the surface of the well. Rupture disks 38 are known in the art. Upon rupturing, rupture disk 38 forms passage 42 through which fluid can flow to contact the upper side of piston 14.

In operation, downhole tool 100 is lowered into a well (not shown) containing a well fluid by a string (not shown) of conduit that would be attached to mandrel assembly 16. In one technique, during the running-in, the portion of piston 14 above seals 20 and retaining member 26 are isolated from wellbore fluid, and tool actuator 24 and the portion of piston 14 below seals 20 are also isolated from wellbore fluid. The pressure on the upper and lower sides of seals 20 would be at atmospheric. The pressure difference on the exterior and interior sides of rupture disk 38 would be the difference between the hydrostatic pressure of the well fluid and atmospheric. Upon reaching a certain depth or a certain hydrostatic pressure of well fluid, rupture disk 38 breaks away, forming passage 42 and exposing the upper side of piston 14, through passage 42, to the wellbore environment. Fluid enters passage 42 and contacts the upper side of piston 14. This fluid is at the hydrostatic pressure of the wellbore fluid and exerts a downward force on piston 14 because the pressure below seals 20 is atmospheric. This downward force on piston 14 is initially resisted by retaining member 26. After a sufficient amount of time, preferably pre-determined by the operator of the downhole tool, the downward force overcomes the resistance of the restraining member 26 and extrudable material 27 of restraining member 26 begins to be moved, or extruded, through opening 34 and into chamber 32 such that retaining member 26 is no longer able to maintain actuating member 12, e.g., piston 14, in its "run-in" position. As a result, actuating member 12, e.g., piston 14, moves downward and actuates downhole tool 100 by moving tool actuator 24 downward to the position shown in FIGS. 2 and 3.

Although the trigger device described in greater detail with respect to FIGS. 1-3 is directed to actuation of a piston as the actuating member, it is to be understood that the trigger device disclosed herein may be used in connection with any type of actuatable device known to persons of ordinary skill in the art. For example, the actuating member may be valve, ring or collet of a retractable seat such as a retractable ball seat, or any other device or member of a downhole tool that can be actuated.

Additionally, as well be recognized by persons of ordinary skill in the art, downhole tool 100 can be customized for controlled and steady actuation based upon different types of extrudable materials, larger or smaller volumes of extrudable materials, different shapes of extrudable materials, larger or smaller opening(s), higher or lower wellbore temperatures, and higher or lower forces acting on actuating member to move or extrude the extrudable material.

It is to be understood that the invention is not limited to the exact details of construction, operation, exact materials, or embodiments shown and described, as modifications and equivalents will be apparent to one skilled in the art. For example, the retaining member may be formed completely out of the extrudable material. Alternatively, extrudable fasteners or other structural components may hold retaining member in place. Upon movement of the extrudable material, the retaining member falls out of or otherwise becomes removed from its retaining position and, thus, the actuating member is permitted to move. Moreover, although movement of a piston is shown in most of the embodiments herein as the apparatus and method for setting the downhole tool, any type of trigger device for the downhole tool is envisioned regardless of shape or the nature of its movement or whether the movement directly or indirectly sets the downhole tool. Additionally, the downhole tool does not require a separate chamber especially and solely designed for receiving the extrudable material. Instead, the extrudable material can be moved into any suitable void already carried within the downhole tool. Further, more than one opening may be in fluid communication with the chamber and the extrudable material of the restraining member to increase the rate of extrusion of the extrudable material and, thus, increase the rate of actuation of the downhole tool. Moreover, the trigger devices may not have a chamber or openings into and through which the extrudable material is extruded. Instead, the extrudable material is sufficiently compressible to allow actuation of the downhole tool. Also, the rupture disk could be eliminated, and the extrusion beginning as a result of exposure to temperature and wellbore hydrostatic pressure for a selected time. The piston could be exposed to hydrostatic pressure on both sides, but have differential pressure areas to cause movement. Accordingly, the invention is therefore to be limited only by the scope of the appended claims.

What is claimed is:

1. A trigger device for a downhole well tool, the trigger device capable of selectively actuating the downhole tool, the trigger device comprising:

a housing;

an actuating member operatively carried by the housing, wherein the movement of the actuating member from a first position to a second position causes a downhole tool to perform a specified function; and a restraining member operatively associated with the actuating member to initially prevent movement of the actuating member from the first position to the second position, the restraining member comprising a solid extrudable material adjacent an opening, wherein a selected force acting on the actuating member causes the actuating member to push at least a portion of the extrudable material through the opening, allowing the actuating member to move from the first position to the second position.

2. The trigger device of claim 1, wherein the actuating member comprises a piston.

3. The trigger device of claim 2, wherein the extrudable material is mounted in contact with the piston.

4. The trigger device of claim 3, wherein the opening is located in a shoulder in the housing and the extrudable material is located between the piston and the shoulder.

5. The trigger device of claim 4, wherein the housing includes a rupture disk in fluid communication with one side of the piston for creating a passage for wellbore fluid to the one side of the piston when a selected wellbore pressure is reached.

6. The trigger device of claim 2, wherein the piston is located in a chamber that is selectively exposed to hydrostatic pressure in the well to create the selected force on the piston.

7. The trigger device of claim 1, wherein the housing includes a cavity for receiving the extrudable material after being pushed through the opening.

8. The trigger device of claim 1, wherein the extrudable material comprises a sleeve mounted around a portion of the actuating member.

9. The trigger device of claim 1, wherein the extrudable material comprises a polymer.

10. A trigger device for a downhole well tool, the trigger device capable of selectively actuating the downhole tool, the trigger device comprising:

a housing;

a piston operatively carried by the housing, wherein the movement of the piston from a first position to a second position causes a downhole tool to perform a specified function; and a restraining member operatively associated with the piston to initially prevent movement of the piston from the first position to the second position, the restraining member comprising a solid extrudable material adjacent an opening, the opening being located in a shoulder in the housing and the extrudable material being located between the piston and the shoulder, wherein a selected force acting on the piston causes the piston to push at least a portion of the extrudable material through the opening, allowing the piston to move from the first position to the second position.

11. The trigger device of claim 10, wherein the extrudable material is a polymer.

12. The trigger device of claim 10, wherein the housing includes a rupture disk in fluid communication with one side of the piston for creating a passage for wellbore fluid to the one side of the piston when a selected wellbore pressure is reached.

13. The trigger device of claim 10, wherein the piston is located in a chamber that is selectively exposed to hydrostatic pressure in the well to create the selected force on the piston.

14. The trigger device of claim 10, wherein the housing includes a cavity for receiving the extrudable material after being pushed through the opening.

15. The trigger device of claim 10, wherein the extrudable material comprises a sleeve mounted around a portion of the actuating member.

16. A method of selectively actuating a downhole tool, the method comprising the steps of:

(a) retaining an actuating member of a downhole tool against movement with a restraining member, wherein the restraining member comprises at least one solid extrudable material located adjacent an opening;

(b) lowering the tool into a wellbore;

(c) applying a force to the actuating member; then (d) pushing the extrudable material with the actuating member through the opening and actuating the downhole tool in response to the movement of the actuating member.

17. The method of claim 16, wherein step (c) is performed by placing the actuating member into fluid communication with a wellbore environment.

18. The method of claim 16, wherein step (c) is performed by applying hydrostatic pressure of the wellbore to a piston of the actuating member.

19. The method of claim 18, wherein step (c) is performed by isolating the piston of the actuating member from wellbore fluid in the wellbore until reaching a desired setting depth, then placing the piston of the actuating member in fluid communication with the wellbore fluid.

20. The method of claim 18, wherein the piston of the actuating member is placed in fluid communication with hydrostatic pressure of the wellbore by rupturing a rupture disk.

* * * * *